US005737955A

United States Patent [19]

Ohya et al.

[11] Patent Number: 5,737,955

[45] Date of Patent: Apr. 14, 1998

[54] METHOD FOR INCLEARING THICKNESS OF OUTER PERIPHERAL PORTION OF DISC, AND METHOD FOR MOLDING DISC MEMBER HAVING TRANSMITTING PORTION IN OUTER PERIPHERY THEREOF

[75] Inventors: Masakiyo Ohya; Tamio Totsuka, both of Kosai, Japan

[73] Assignee: Fujikiko Kabushiki Kaisha, Tokyo, Japan

[21] Appl. No.: 705,429

[22] Filed: Aug. 29, 1996

[30] Foreign Application Priority Data

Aug. 31, 1995 [JP] Japan ..... 7-223911

[51] Int. Cl.[6] ..... B21H 5/00

[52] U.S. Cl. ..... 72/102; 29/893.32; 72/110

[58] Field of Search ..... 72/68, 102, 110, 72/111; 29/892, 893.32, 894.324, 894.325

[56] References Cited

U.S. PATENT DOCUMENTS

| | | | |
|---|---|---|---|
| 5,072,509 | 12/1991 | Bichel et al. | 72/111 |
| 5,113,584 | 5/1992 | Wenzel | 29/892 |
| 5,396,787 | 3/1995 | Kanemitsu et al. | 72/111 |

FOREIGN PATENT DOCUMENTS

| | | |
|---|---|---|
| 0 397 901 | 11/1990 | European Pat. Off. . |
| 0 555 631 A1 | 8/1993 | European Pat. Off. . |
| 4917925 A1 | 12/1990 | Germany . |
| 43 14 558 A1 | 11/1994 | Germany . |

*Primary Examiner*—Lowell A. Larson
*Attorney, Agent, or Firm*—Jones & Askew, LLP

[57] ABSTRACT

In a method for increasing the thickness of an outer peripheral portion of a metallic disc material, a first forming die is prepared so as to have a first groove portion on an outer periphery thereof for receiving the metallic disc material. The first groove portion has a pair of side walls and a bottom wall therebetween. The side walls has inclined surfaces facing each other so as to increase the width of the first groove portion toward the outer peripheral portion of the metallic disc material. One of the side walls has a greater length from the bottom wall of the first groove portion than that of the other side wall. The first cylindrical forming die is pressed against the outer peripheral portion of the metallic disc material in a radial direction to form a thickened outer peripheral portion of the metallic disc material. When the first forming die is pressed against the outer peripheral portion of the metallic disc material in the radial direction, the inclined surface of the one side wall of the first forming die is brought into contact with one surface of the outer peripheral portion of the metallic disc material, so that the outer peripheral portion of the metallic disc material is bent in a direction along the inclined surface of the one side wall while molding the thickened outer peripheral portion of the metallic disc material in the first groove portion.

11 Claims, 5 Drawing Sheets

METHOD FOR INCLEARING THICKNESS OF OUTER PERIPHERAL PORTION OF DISC, AND METHOD FOR MOLDING DISC MEMBER HAVING TRANSMITTING PORTION IN OUTER PERIPHERY THEREOF

BACKGROUND OF THE INVENTION

1. Field of the Invention

The present invention relates to a method for increasing the thickness of an outer peripheral portion of a disc, and a method for molding a disc member having a transmitting portion in the outer periphery thereof. More specifically, the invention relates to a method for increasing the thickness of an outer peripheral portion of a disc and a method for molding a disc member having a transmitting portion in the outer periphery thereof, the methods being suitable for the manufacturing of a drive plate connected to a drive gear of a clutch for an automotive vehicle.

2. Description of the Related Art

Japanese Patent Laid-Open No. 4-279239 discloses a method for manufacturing a drive plate which is used for transmitting power from an engine section to a reduction gear via a crankshaft for an automotive vehicle. In this method, an outer peripheral portion of a disc material is swaging-processed in axial directions by means of a swaging die, so as to thicken the outer peripheral portion of the disc material to mold a gear on the outer or inner periphery of the thickened portion.

Referring to FIGS. 1 through 5, this method will be described below.

First, as shown in FIG. 1, a metallic disc material 101 is clamped and fixed by a stationary base 102 and a pressing plate 103, and the positioning thereof is carried out by means of a positioning pin 104. Then, as shown in FIG. 2, an outer peripheral portion of the disc material 101 is pressed in an axial direction by means of a first swaging die 105 so that a first swaging processing is carried out so as to increases the thickness of the disc material while thinning the outer peripheral portion. Then, as shown in FIG. 3, a second swaging processing of a swaging-processed portion 101*a* is carried out by means of a second swaging die 106 so that the swaging-processed portion 101*a* has a rectangular cross-section.

As shown in FIG. 4, the disc material 101 thus swaging-processed is molded by means of a lower die 107, an upper die 108 and an outer die 109 so as to mold a tray-shaped blank 110. Then, as shown in FIG. 5, a tooth form is formed on the thickened portion of the blank 110 by press-fitting a supporting die 112 in an axial direction while the blank is held between an external tooth-form die 111 and the supporting die 112. At this time, the outer diameter of the supporting die 112 is greater than the inner diameter of the blank 110, so that the press-fitting of the supporting die 112 extends the swaging-processed portion 101*a* of the blank 110 outwards to mold an external tooth form.

However, according to the aforementioned manufacturing method, as shown in FIG. 2, a buckling tends to occur on the disc material 101 when the outer periphery portion of the disc material 101 is pressed by the first swaging die 105. Therefore, there is a disadvantage in that the length of the outer periphery of the disc material 101 projecting from the portion between the stationary base 102 and the pressing plate 103 can not be increased to sufficiently mold the thickened portion. In addition, in order to prevent the buckling from occurring, the thickening speed must be decreased, so that the productivity is lowered. In addition, in order to increase the thickened amount, the thickening must be divided into a number of steps to change the stationary base 102 and the pressing plate 103 each time, so that the working efficiency is low. Moreover, according to the aforementioned manufacturing method, for each of the steps of the swaging process, the blank molding and the tooth-form molding, the disc material 101 must be mounted on the corresponding tool, so that the working efficiency is low.

SUMMARY OF THE INVENTION

It is therefore an object of the present invention to eliminate the aforementioned problems and to provide a method for increasing the thickness of an outer peripheral portion of a disc and a method for molding a disc member having a transmitting portion in the outer periphery thereof, which can prevent a buckling from occurring when molding a thickened portion, which can increase the thickened-portion molding speed and the thickened amount, and which can improve the productivity.

In order to accomplish the aforementioned and other objects, according to one aspect of the present invention, a method for increasing the thickness of an outer peripheral portion of a metallic disc material, comprises the steps of: clamping a central portion of a metallic disc material by means of a tool; preparing a first forming die having a first groove portion on an outer periphery thereof for receiving the metallic disc material, the first groove portion having a pair of side walls and a bottom wall therebetween, the side walls having inclined surfaces facing each other so as to increase the width of the first groove portion toward the outer peripheral portion of the metallic disc material, one of the side walls having a greater length from the bottom wall of the first groove portion than that of the other side wall; and pressing the first cylindrical forming die against the outer peripheral portion of the metallic disc material in a radial direction to form a thickened outer peripheral portion of the metallic disc material, wherein when the first forming die is pressed against the outer peripheral portion of the metallic disc material in the radial direction, the inclined surface of the one side wall of the first forming die is brought into contact with one surface of the outer peripheral portion of the metallic disc material, so that the outer peripheral portion of the metallic disc material is bent in a direction along the inclined surface of the one side wall while molding the thickened outer peripheral portion of the metallic disc material in the first groove portion.

According to this thickening method, when the first groove portion of the first forming die is pressed against the outer peripheral portion of the metallic disc material to mold a thickened portion on the metallic disc material, one surface of the outer peripheral portion of the metallic disc material is bent in one direction while contacting one of the inclined surfaces of the first groove portion, and then, it contacts the bottom surface of the first groove portion to form the thickened portion. Therefore, it is possible to prevent a buckle from occurring in the metallic disc material.

This thickening method may further comprise the steps of: preparing a second cylindrical forming die having the same structure as that of the first forming die except that the second forming die has a second groove portion on the outer periphery thereof, the second groove portion having a greater width than that of the first groove portion of the first forming die; and pressing the second forming die against the thickened portion formed by the first forming die to further mold the thickened outer peripheral portion.

According to this thickening method, it is possible to easily increase the amount of the thickened portion by means of the second forming die having the second groove portion which has a greater width than that of the first groove portion of the first forming die. The inclined surface of the second groove portion also prevent a buckle from occurring.

In this thickening method, the plurality of forming dies may be arranged so as to be movable on the outer peripheral portion of the metallic disc material in radial directions, and the outer peripheral portion of the metallic disc material projecting from the tool being, in turn, processed on the same tool. In this case, since the outer peripheral portion of the metallic disc material is, in turn, processed while the metallic disc material is clamped by the same tool, it is possible to decrease the processing time.

In this thickening method, the inclined surface of the one side wall of the first forming die contacting the one surface of the outer peripheral portion of the metallic material may have an inclined angle in the range of from 0.5 to 15 degrees with respect to a plane perpendicular to the axis of the metallic disc material. In this case, one surface of the metallic disc material contacts one of the inclined surface by forming the one inclined surface contacting the one surface of the metallic disc material so as to have an inclined angle in the range of from 0.5 to 15 degrees, so that it is possible to prevent a buckle from occurring.

In this thickening method, the inclined surface of the other side wall of the first forming die may have an inclined angle in the range of from 0.5 to 3 degrees with respect to a plane perpendicular to the axis of the metallic disc material. In this case, it is possible to increase the thickness of the outer peripheral end portion of the metallic disc material in the first groove portion of the first forming die by forming the other inclined surface so as to have an inclined angle in the range of 0.5 to 3 degrees.

According to another aspect of the present invention, a method for molding a disc member having a transmitting portion on the outer periphery thereof, comprises the steps of: clamping a central portion of a metallic disc material by means of a tool; preparing a first forming die having a first groove portion on an outer periphery thereof for receiving the metallic disc material, the first groove portion having a pair of side walls and a bottom wall therebetween, the side walls having inclined surfaces facing each other so as to increase the width of the first groove portion toward the outer peripheral portion of the metallic disc material, one of the side walls having a greater length from the bottom wall of the first groove portion than that of the other side wall; pressing the first cylindrical forming die against the outer peripheral portion of the metallic disc material in a radial direction to form a thickened outer peripheral portion of the metallic disc material, wherein when the first forming die is pressed against the outer peripheral portion of the metallic disc material in the radial direction, the inclined surface of the one side wall of the first forming die is brought into contact with one surface of the outer peripheral portion of the metallic disc material, so that the outer peripheral portion of the metallic disc material is bent in a direction along the inclined surface of the one side wall while molding the thickened outer peripheral portion of the metallic disc material in the first groove portion; and pressing a forth forming die which has a rolling portion for molding a transmitting portion, against the thickened outer peripheral portion of the metallic disc material in a radial direction, so as to mold the transmitting portion on the thickened outer peripheral portion of the metallic disc material.

According to this disc-member molding method, when the first groove portion of the first forming die is pressed against the outer peripheral portion of the metallic disc material to mold a thickened portion on the metallic disc material, one surface of the outer peripheral portion of the metallic disc material is bent in one direction while contacting one of the inclined surfaces of the first groove portion, and then, it contacts the bottom surface of the first groove portion to form the thickened portion. Therefore, it is possible to prevent a buckle from occurring in the metallic disc material.

This disc-member molding method may further comprise the steps of: before the step of pressing the first forming die, preparing a second cylindrical forming die having the same structure as that of the first forming die except that the second forming die has a second groove portion on the outer periphery thereof, the second groove portion having a greater width than that of the first groove portion of the first forming die; and pressing the second forming die against the thickened outer peripheral portion formed by the first forming die to further mold the thickened outer peripheral portion.

According to this disc-member molding method, it is possible to easily increase the amount of the thickened portion by means of the second forming die having the second groove portion which has a greater width than that of the first groove portion of the first forming die. The inclined surface of the second groove portion also prevent a buckle from occurring.

This disc-member molding method may further comprise the step of: before the step of pressing of the fourth forming die, directly pressing a third forming die having a peripheral groove of a substantially rectangular shape on the outer periphery thereof, against the outer peripheral portion of the metallic disc material so that the outer peripheral portion has a predetermined shape. In this case, the thickened portion is molded so as to have a predetermined shape by means of the third forming die, so that it is possible to easily mold the transmitting portion.

In this disc-member molding method, the plurality of forming dies may be arranged so as to be movable on the outer peripheral portion of the metallic disc material in radial directions, and the outer peripheral portion of the metallic disc material projecting from the tool being, in turn, processed on the same tool. In this case, since the outer peripheral portion of the metallic disc material is, in turn, processed while the metallic disc material is clamped by the same tool, it is possible to decrease the processing time.

In this disc-member molding method, the inclined surface of the one side wall of the first forming die contacting the one surface of the outer peripheral portion of the metallic material may have an inclined angle in the range of from 0.5 to 15 degrees with respect to a plane perpendicular to the axis of the metallic disc material. In this case, one surface of the metallic disc material contacts one of the inclined surface by forming the one inclined surface contacting the one surface of the metallic disc material so as to have an inclined angle in the range of from 0.5 to 15 degrees, so that it is possible to prevent a buckle from occurring.

In this disc-member molding method, the inclined surface of the other side wall of the first forming die may have an inclined angle in the range of from 0.5 to 3 degrees with respect to a plane perpendicular to the axis of the metallic disc material. In this case, it is possible to increase the thickness of the outer peripheral end portion of the metallic disc material in the first groove portion of the first forming die by forming the other inclined surface so as to have an inclined angle in the range of 0.5 to 3 degrees.

BRIEF DESCRIPTION OF THE DRAWINGS

The present invention will be understood more fully from the detailed description given herebelow and from the accompanying drawings of the preferred embodiment of the invention. However, the drawings are not intended to imply limitation of the invention to this specific embodiment, but are for explanation and understanding only.

In the drawings:

FIG. 1 is a sectional view illustrating a disc material clamped by a base and a plate.

FIG. 2 is a sectional view illustrating the first process of swaging process.

FIG. 3 is a sectional view illustrating the second process of swaging process.

FIG. 4 is a sectional view illustrating a process to form a blanc in a shape of saucer.

FIG. 5 is a sectional view illustrating a process to form teeth on the circumference of the disc.

DESCRIPTION OF THE PREFERRED EMBODIMENT

Figure 1:
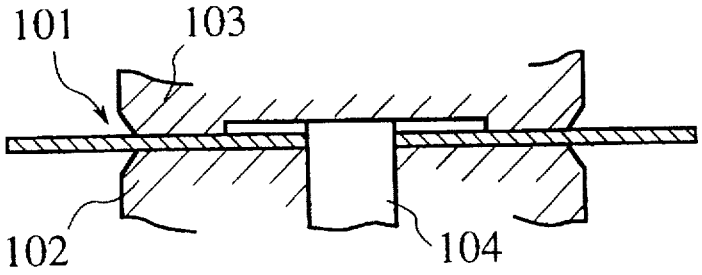
FIG.1 PRIOR ART
FIG. 1 through 5 are sectional views illustrating an example of a conventional method for manufacturing a drive plate.

Referring now to the drawings, particularly to FIGS. 6 through 11, the preferred embodiment of a method for increasing the thickness of an outer peripheral portion of a disc and a forming die for use therein, according to the present invention, will be described below.

Figure 6:
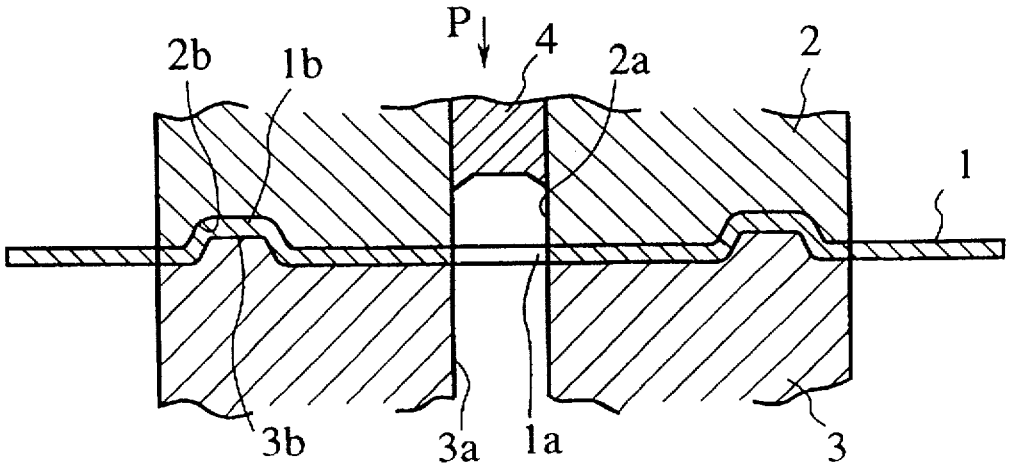
FIG. 6 is a sectional view illustrating a process to form disc material which is used for the method for increasing the thickness of a peripheral portion of a disc material.

First, as shown in FIG. 6, the press working of a metallic disc material 1 of a given outer diameter is carried out by means of an upper die 2, a lower die 3 and a trimming die 4 to form an axial hole 1*a* and an annular stepped portion 1*b* coaxial with the axial hole 1*a*. The central portions of the upper die 2 and the lower die 3 are formed with guide holes 2*a* and 3*a*, respectively, for guiding the cylindrical trimming die 4 in axial directions, i.e. in the upward and downward directions. In addition, the upper die 2 and the lower die 3 are formed with a recessed portion 2*b* and a projecting portion 3*b*, respectively, so that the recessed portion 2*b* and the projecting portion 3*b* face each other, for molding the annular stepped portion 1*b* around the axial hole 1*a* of the metallic disc material 1.

When the metallic disc material 1 is clamped and pressed between the upper die 2 and the lower die 3, the annular stepped portion 1*b* is molded. Then, when the trimming die 4 is depressed in the direction of arrow P, the axial hole 1*a* is molded.

Figure 7A:
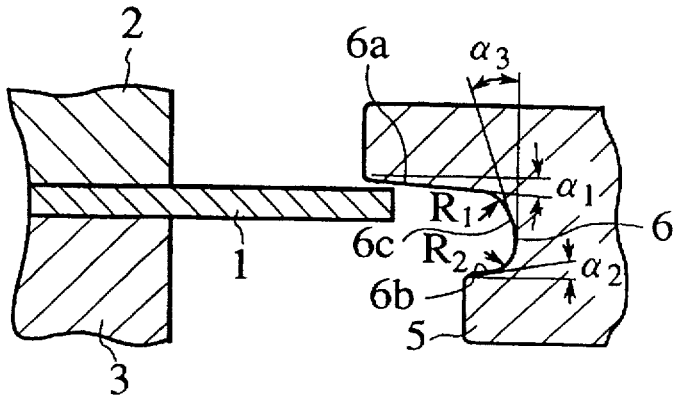
FIG. 7A, 7B and 7C are sectional views illustrating the first process for increasing thickness in one embodiment of the method for increasing thickness of peripheral portion of a disc material concerning the present invention.
Figure 7B:
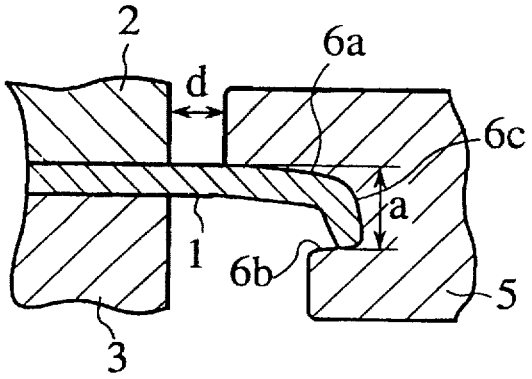
Figure 7C:
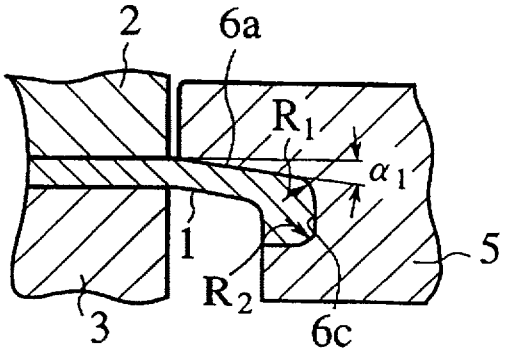

Then, while the metallic disc material 1 is clamped between the upper die 2 and the lower die 3, a first thickened-portion molding serving as a first step is carried out using a first roller 5 serving as a first forming die as shown in FIG. 7. The first roller 5 is rotatably supported on a shaft (not shown) which is arranged in parallel to the axis of the dies 2 and 3. The outer periphery of the first roller 5 is formed with a groove portion 6 which will be described later. While the metallic disc material 1 clamped by the dies 2 and 3 is rotated, the first roller 5 is pressed against the outer periphery of the metallic disc material 1 projecting from the dies 2 and 3 to carry out the first thickened-portion molding.

As shown in FIG. 7, the groove portion 6 formed in the outer periphery of the first roller 5 has side surfaces 6*a* and 6*b* facing each other, and a bottom surface 6*c*. The side surfaces 6*a* and 6*b* are inclined surfaces so as to increase the width therebetween toward the outer periphery. In addition, the outer diameter of the first roller 5 on the side of one inclined surface 6*a* is greater than that of the first roller 5 on the side of the other inclined surface 6*b*. Moreover, the inclined angle $\alpha 1$ of the inclined surface 6*a* is in the range of from 0.5 to 15 degrees with respect to the surface perpendicular to the axis of the first roller 5, and the inclined angle $\alpha 2$ of the inclined surface 6*b* is in the range of from 0.5 to 3 degrees with respect thereto. Alternatively, the outer diameter of the first roller 5 on the side of the side surface 6*b* may be increased so that the outer diameters of both side surfaces 6*a* and 6*b* are equal to each other.

On the other hand, the bottom surface 6*c* of the groove portion 6 is inclined at an angle $\alpha 3$ of 0.5 to 15 degrees with respect to the axis of the first roller 5. In addition, the radius R1 of curvature between the inclined surface 6*a* and the bottom surface 6*c* is greater than the radius RE of curvature between the inclined surface 6*b* and the bottom surface 6*c*. Furthermore, the radiuses R1 and R2 of curvature are suitably set in the range of from 1 mm to 3 mm.

When the inclined angle $\alpha 1$ of the inclined surface 6*a* of the groove portion 8 is set to be less than 0.5 degrees, the bottom surface 6*c* of the groove portion 6 of the first roller 5 and the outer peripheral end portion of the metallic disc material 1 are rotated in synchronism with each other. Therefore, friction occurs between one surface of the metallic disc material 1 and the inclined surface 6*a*, so that a friction mark is adhered to the one surface of the metallic disc material 1 and the inclined surface 6*a* is worn to lower the durability. In addition, the metallic disc material 1 tends to buckle toward the other surface (downwards in FIG. 7(*a*)) due to a radial load. On the other hand, when the inclined angle $\alpha 1$ of the inclined surface 6*a* is set to be greater than 15 degrees, the metallic disc material 1 tends to buckle toward the one surface at the portion of the metallic disc material 1 which does not contact the inclined surface 6*a*.

In addition, when the inclined angle $\alpha 2$ of the inclined surface 6*b* of the groove portion 6 is set to be less than 0.5 degrees, friction occurs between the metallic disc material 1 and the inclined surface 6*b*, so that a friction mark is adhered to the metallic disc material 1, and the inclined surface 6*b* is worn to lower the durability, similar to the inclined surface 6*a*. On the other hand, when the inclined angle $\alpha 2$ of the inclined surface 6*b* is set to be greater than 3 degrees, the outer peripheral end portion of the metallic disc material 1 does not stay in the groove portion 6 to escape outside, so that the thickening can not be sufficiently carried out in a predetermined width.

Moreover, the inclined angle α3 of the bottom surface 6c of the groove portion 6 is provided for adjusting the thickened portion. When the inclined angle α3 is small, the base side (the upper side in FIG. 7(*b*)) is first thickened, and when the inclined angle α3 is large, the tip end side (the lower side in FIG. 7(*b*)) is first thickened. However, when the inclined angle α3 is set to be greater than 15 degrees, the thickening can not be sufficiently carried out on the base side of the thickened portion.

A first thickened-portion molding procedure in the first step will be described below.

As shown in FIG. 7(*a*), one surface of the metallic disc material 1 is brought into contact with the inclined surface 6a of the groove portion 6 of the first roller 5, and the first roller 5 is pressed towards the dies 2 and 3 while rotating the metallic disc material 1. As a result, as shown in FIG. 7(*b*), the metallic disc material 1 is bent in one direction along the inclined surface 6a, and contacts the bottom surface 6c to be pressed. Then, when the first roller 5 is further pressed against the dies 2 and 3, the periphery of the metallic disc material 1 is thickened in the groove portion 6 as shown in FIG. 7(*c*).

Figure 2:
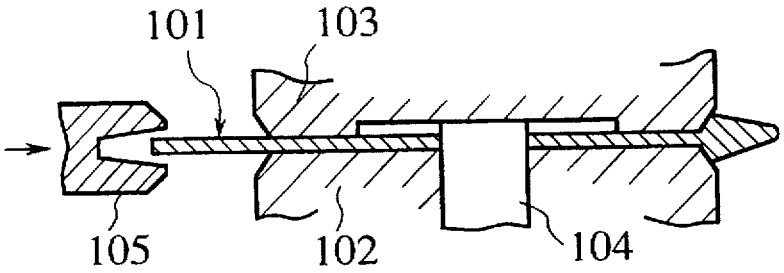
FIG.2 PRIOR ART
Figure 3:
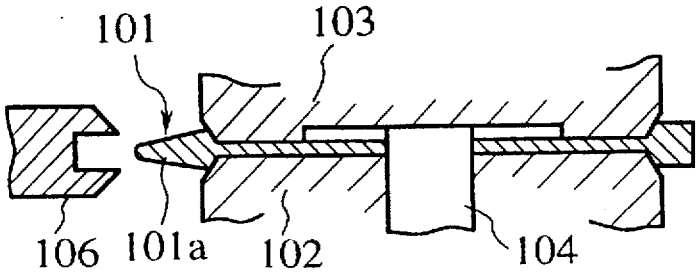
FIG.3 PRIOR ART
Figure 4:
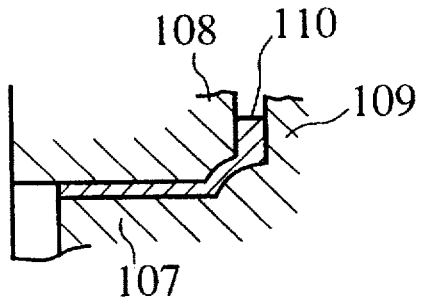
FIG.4 PRIOR ART
Figure 5:
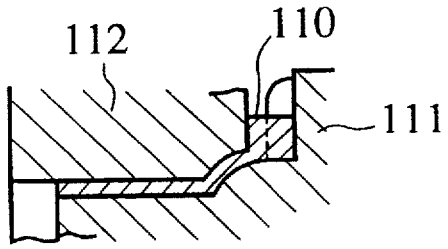
FIG.5 PRIOR ART

At this time, since the metallic disc material 1 is bent in one direction along the inclined surface 6a of the groove portion 6, it is possible to prevent a buckling from occurring. In addition, since the circular portions of radiuses R1 and R2 of curvature (R1>R2) are formed on both sides of the bottom surface 6c of the groove portion 6, it is possible to smoothly carry out the flow of metal particles of the metallic disc material 1 during the thickened-portion molding. Moreover, since the metallic disc material 1 is clamped by the dies 2 and 3 via the stepped portion 1b, it is possible to prevent the whole metallic disc material 1 from being distorted due to stress during the thickened-portion molding. Furthermore, if the thickening stroke is decreased in a range expressed by d in FIG. 2(*b*) wherein the metallic disc material 1 extremely tends to be buckled when the thickened-portion molding as shown in FIG. 2(*b*) is carried out, it is possible to prevent the buckling to easily increase the thickness.

Figure 8:
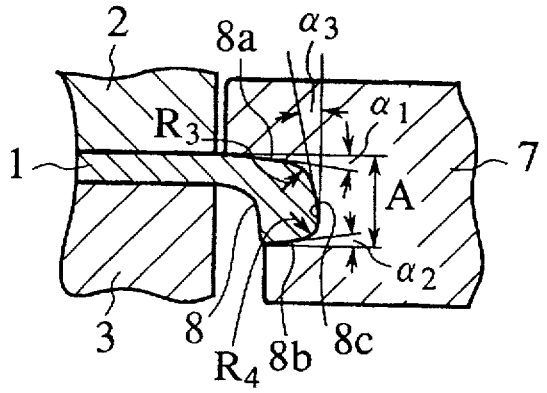
FIG. 8 is a sectional view illustrating the second process for increasing thickness in one embodiment of the method for increasing thickness of peripheral portion of a disc material concerning the present invention.

Then, as shown in FIG. 8, a second thickened-portion molding is carried out using a second roller 7 serving as a second forming die. The structure of the second roller 7 is the same as that of the first roller 5, except that the width A of a groove portion 8 formed in the outer periphery of the second roller 7 is greater than the width a of the groove portion 6 of the first roller 5. Similar to the first step, the thickened portion molded in the second step is pressed against the interior of the groove portion 8 of the second roller 7, so as to mold the thickened portion again.

Similar to the first step, in this second thickened-portion molding, it is possible to prevent the buckling by an inclined surface 8a and to smoothly carry out the flow of metal particles of the metallic disc material 1 due to radiuses R3 and R4 of curvature. In addition, since the width A of the groove portion 8 is greater than the width a of the groove portion 6 of the first roller 5, it is possible to increase the amount of the thickened portion.

Figure 9:
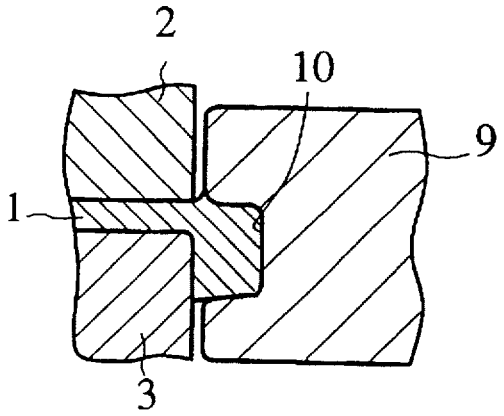
FIG. 9 is a sectional view illustrating one process of the embodiment of the method for forming a disc material with transmitting portion on the outer circumference thereof.

Then, as shown in FIG. 9, using a third roller 9 serving as a third forming die, the outer periphery of the thickened portion of the metallic disc material 1 is molded so as to have a shape required to mold a gear serving as a transmitting portion. The outer periphery of the third roller 9 is formed with a groove portion 10 having a cross-section of substantially rectangular shape. The third roller 9 is pressed against the outer peripheral of the thickened portion of the metallic disc material 1, so that the thickened portion has a cross-section of substantially rectangular shape.

Figure 10:
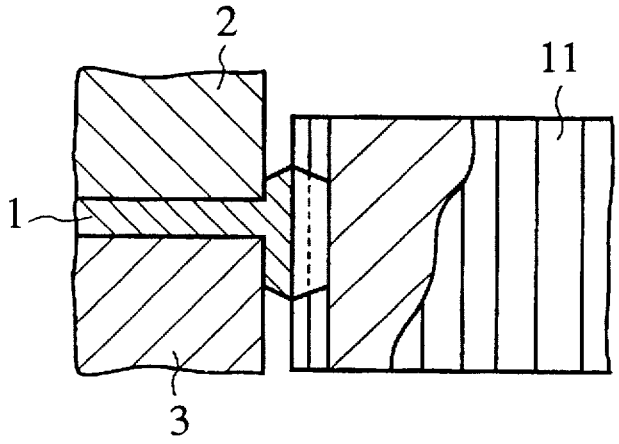
FIG. 10 is a sectional view illustrating a process for forming the transmitting portion in the embodiment of the method for forming a disc material with transmitting portion on the outer circumference thereof.

Then, as shown in FIG. 10, as a second step, the outer periphery of the thickened portion molded in a rectangular shape is pressed against a gear rolling roller 11 serving as a fourth forming die to mold a gear. At this time, the portion projecting on both sides of the thickened portion is trimmed so that the gear has a required shape.

According to the aforementioned method for increasing the thickness of the outer periphery of the metallic disc material 1 using the rollers 5 and 7 serving as forming dies, since the groove portions 6 and 8 formed in the outer peripheries of the rollers 5 and 7 are have the inclined surfaces, respectively, it is possible to prevent a buckling from occurring when the thickened portion is molded, and it is possible to increase the thickened-portion molding speed. In addition, if such a buckling preventing portion is provided, it is possible to increase the amount of the thickened portion in each of processes.

Figure 11:
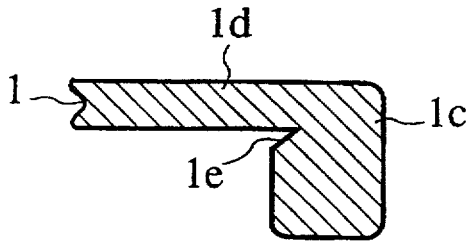
FIG. 11 is a sectional view illustrating undercut generated in the conventional method for increasing thickness.

Moreover, since it is possible to adjust the position of the thickened portion of the outer peripheral portion of the metallic disc material 1 by suitably adjusting the angles of the inclined surfaces provided on the bottom portions 6c and 8c of the groove portions 6 and 8, it is possible to prevent an undercut 1e from being produced in the boundary portion between a thickened portion 1c and a plate portion 1d as shown in FIG. 11. In addition, since the portion in which the inclined surfaces of the groove portions 6 and 8 contact the bottom surface is circular or arched, it is possible to smoothly carry out the flow of metallic particles when the molding is carried out, so that it is possible to improve the strength and durability of a product.

In addition, the rollers 5, 7, 9 and 11 are arranged on the outer periphery of the metallic disc material 1 clamped by the dies 2 and 3 so as to move in radial directions, and the rollers 5, 7, 9 and 11 are, in turn, pressed against the outer periphery of the metallic disc material 1 to carry out the molding thereof. Therefore, it is possible to carry out the moldings at all the steps by only one clamp without changing the die, so that it is possible to improve the working efficiency.

In the aforementioned preferred embodiment, while the thickened portion has been molded on the outer periphery of the metallic disc material 1, and the gear serving as the transmitting portion has been molded on the outer periphery of the thickened portion to manufacture a drive plate for an automotive vehicle, the product should not be limited thereto according to the present invention. For example, the present invention can be applied to manufacture a pulley serving as a transmitting portion by molding a peripheral groove of a thickened portion. In this case, the same effect can be obtained.

As mentioned above, in a method for increasing the thickness of an outer peripheral portion of a disc and a method for molding a disc member according to the present invention, a groove portion having inclined surfaces on the outer periphery of a die is formed, and one surface of a metallic disc material is pressed against one of inclined surfaces to mold a thickened portion. Therefore, it is possible to mold a thickened portion of a large volume at a high speed while preventing a buckling from occurring. In addition, forming dies used at each steps are arranged on a metallic material clamped by the same tool so as to be movable in radial directions, and the respective steps are performed in turn, so that it is possible to improve the working efficiency.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. A method for increasing the thickness of an outer peripheral portion of a metallic disc material, comprising the steps of:

clamping a central portion of a metallic disc material by means of a tool;

preparing a first cylindrical forming die having a first groove portion on an outer periphery thereof for receiving said metallic disc material, said first groove portion having a pair of side walls and a bottom wall therebetween, said side walls having inclined surfaces facing each other so as to increase the width of said first groove portion toward said outer peripheral portion of said metallic disc material,; the inclined surface of one of the side walls having an inclined angle in the range of from 0.5 to 15 degrees with respect to a plane perpendicular to the axis of the metallic disc material;

pressing the first cylindrical forming die against the outer peripheral portion of the metallic disc material in a radial direction, so that the inclined surface of the one of the side walls is brought into contact with one surface of the outer peripheral portion of the metallic disc material, whereby the outer peripheral portion of the metallic disc material is bent in a direction along the inclined surface of the one of the side walls; and further pressing the first cylindrical forming die against the outer peripheral portion of the metallic disc material in the radial direction, so that the outer peripheral portion of the metallic disc material is thickened in said first groove portion.

2. A method for increasing the thickness of an outer peripheral portion of a metallic disc material as set forth in claim 1, which further comprises the steps of:

preparing a second cylindrical forming die having the same structure as that of said first forming die except that the second forming die has a second groove portion on the outer periphery thereof, said second groove portion having a greater width than that of said first groove portion of said first forming die; and pressing said second forming die against the thickened portion formed by said first forming die to further mold the thickened outer peripheral portion.

3. A method for increasing the thickness of an outer peripheral portion of a metallic disc material as set forth in claim 2, wherein said forming dies are arranged so as to be movable on said outer peripheral portion of said metallic disc material in radial directions, and said outer peripheral portion of said metallic disc material projecting from said tool being, in turn, processed on the same tool.

4. A method for increasing the thickness of an outer peripheral portion of a metallic disc material as set forth in claim 1, wherein the inclined surface of the other side wall of said first forming die has an inclined angle in the range of from 0.5 to 3 degrees with respect to a plane perpendicular to the axis of said metallic disc material.

5. The method for increasing the thickness of an outer peripheral portion of a metallic disc material as in claim 1, wherein the first groove portion of the first cylindrical forming die further has:

a curvature having a first radius between the inclined surface of the one of the side walls and a bottom surface of the bottom wall;

a curvature having a second radius between the inclined surface of the other of the side walls and the bottom surface of the bottom wall; and the first radius is greater than the second radius.

6. A method for molding a disc member having a transmitting portion on the outer periphery thereof, comprising the steps of:

clamping a central portion of a metallic disc material by means of a tool;

preparing a first cylindrical forming die having a first groove portion on an outer periphery thereof for receiving said metallic disc material, said first groove portion having a pair of side walls and a bottom wall therebetween, said side walls having inclined surfaces facing each other so as to increase the width of said first groove portion toward said outer peripheral portion of said metallic disc material,;

the inclined surface of one of the side walls having an inclined angle in the range of from 0.5 to 15 degrees with respect to a plane perpendicular to the axis of the metallic disc material;

pressing said first cylindrical forming die against said outer peripheral portion of said metallic disc material in a radial direction so that the inclined surface of the one of the side walls is brought into contact with one surface of said outer peripheral portion of said metallic disc material, whereby the outer peripheral portion of the metallic disc material is bent in a direction along said inclined surface of said one side wall;

further pressing the first cylindrical forming die against the outer peripheral portion of the metallic disc material in the radial direction, so that the outer peripheral portion of the metallic disc material is thickened in the first groove portion; and pressing a fourth forming die which has a rolling portion for molding a transmitting portion, against said thickened outer peripheral portion of said metallic disc material in a radial direction, so as to mold the transmitting portion on said thickened outer peripheral portion of said metallic disc material.

7. A method for molding a disc member having a transmitting portion on the outer periphery thereof as set forth in claim 6, which further comprises the steps of:

before said step of pressing the fourth forming die, preparing a second cylindrical forming die having the same structure as that of said first forming die except that the second forming die has a second groove portion on the outer periphery thereof, said second groove portion having a greater width than that of said first groove portion of said first forming die; and pressing said second forming die against said thickened outer peripheral portion formed by said first forming die to further mold said thickened outer peripheral portion.

8. A method for molding a disc member having a transmitting portion on the outer periphery thereof as set forth in claim 6, which further comprises the step of:

before said step of pressing of the fourth forming die, directly pressing a third forming die having a peripheral groove of a substantially rectangular shape on the outer periphery thereof, against said outer peripheral portion of said metallic disc material so that said outer peripheral portion has a predetermined shape.

9. A method for molding a disc member having a transmitting portion on the outer periphery thereof as set forth in claim 6, wherein said forming dies are arranged so as to be movable on said outer peripheral portion of said metallic disc material in radial directions, and said outer peripheral portion of said metallic disc material projecting from said tool being, in turn, processed on the same tool.

10. A method for molding a disc member having a transmitting portion on the outer periphery thereof as set forth in claim 6, wherein the inclined surface of the other side wall of said first forming die has an inclined angle in the range of from 0.5 to 3 degrees with respect to a plane perpendicular to the axis of said metallic disc material.

11. The method for molding a disc member having a transmitting portion on the outer member having a transmitting portion on the outer periphery thereof as in claim 6, wherein the first groove portion of the first cylindrical forming die further has:

a curvature having a first radius between the inclined surface of the one of the side walls and a bottom surface of the bottom wall;

a curvature having a second radius between the inclined surface of the other of the side walls and the bottom surface of the bottom wall; and the first radius is greater than the second radius.

* * * * *